US009139895B2

(12) United States Patent
White et al.

(10) Patent No.: US 9,139,895 B2
(45) **Date of Patent: *Sep. 22, 2015**

(54) ZIRCONIUM ALLOY FUEL CLADDING FOR OPERATION IN AGGRESSIVE WATER CHEMISTRY

(75) Inventors: David White, Wilmington, NC (US); Daniel R. Lutz, San Jose, CA (US); Yang-Pi Lin, Wilmington, NC (US); John Schardt, Wilmington, NC (US); Gerald Potts, Wilmington, NC (US)

(73) Assignee: Global Nuclear Fuel—Americas, LLC, Wilmington, NC (US)

( * ) Notice: Subject to any disclaimer, the term of this patent is extended or adjusted under 35 U.S.C. 154(b) by 2152 days.

This patent is subject to a terminal disclaimer.

(21) Appl. No.: 10/935,157

(22) Filed: Sep. 8, 2004

(65) Prior Publication Data

US 2006/0048870 A1 Mar. 9, 2006

(51) Int. Cl.
*C22F 1/18* (2006.01)
*C22C 16/00* (2006.01)

(52) U.S. Cl.
CPC ..... *C22F 1/186* (2013.01); *C22C 16/00* (2013.01)

(58) Field of Classification Search
CPC ..... C22F 1/186; C22C 16/00
USPC ..... 148/421, 519, 672
See application file for complete search history.

(56) References Cited

U.S. PATENT DOCUMENTS 3,963,534 A 6/1976 Frenkel et al.
4,360,389 A 11/1982 Urquhart
4,440,862 A 4/1984 Cheng et al.
4,450,016 A 5/1984 Vesterlund et al.
4,450,020 A 5/1984 Vesterlund et al.
4,512,819 A 4/1985 Steinberg
4,573,629 A 3/1986 Imahashi et al.
4,576,654 A 3/1986 Eddens et al.
4,584,030 A 4/1986 McDonald et al.
4,649,023 A 3/1987 Sabol et al.

(Continued)

FOREIGN PATENT DOCUMENTS

EP 0 071 193 6/1988
EP 0 227 989 11/1994

(Continued)

OTHER PUBLICATIONS

European Search Report dated Nov. 8, 2005.

(Continued)

*Primary Examiner* — Weiping Zhu
(74) *Attorney, Agent, or Firm* — Harness, Dickey & Pierce

(57) ABSTRACT

Disclosed herein are zirconium-based alloys and methods of fabricating nuclear reactor components, particularly fuel cladding tubes, from such alloys that exhibit improved corrosion resistance in aggressive coolant compositions. The fabrication steps include a late-stage β-treatment on the outer region of the tubes. The zirconium-based alloys will include between about 1.30 and 1.60 wt % tin; between about 0.06 and 0.15 wt % chromium; between about 0.16 and 0.24 wt % iron, and between 0.05 and 0.08 wt % nickel, with the total content of the iron, chromium and nickel comprising above about 0.31 wt % of the alloy and will be characterized by second phase precipitates having an average size typically less than about 40 nm. The final finished cladding will have a surface roughness of less than about 0.50 μm Ra and preferably less then about 0.10 μm Ra.

19 Claims, 3 Drawing Sheets

(56) References Cited

U.S. PATENT DOCUMENTS

| | | | |
|---|---|---|---|
| 4,664,727 | A | 5/1987 | Inagaki et al. |
| 4,678,521 | A | 7/1987 | Yoshida et al. |
| 4,717,428 | A | 1/1988 | Comstock et al. |
| 4,717,434 | A | 1/1988 | McDonald et al. |
| 4,735,768 | A | 4/1988 | Stehle et al. |
| 4,764,223 | A | 8/1988 | Charquet et al. |
| 4,810,461 | A | 3/1989 | Inagaki et al. |
| 4,938,921 | A | 7/1990 | Mardon et al. |
| 5,125,253 | A | 6/1992 | Gerretz et al. |
| 5,223,206 | A | 6/1993 | Rosenbaum |
| 5,437,747 | A | 8/1995 | Adamson et al. |
| 5,519,748 | A | 5/1996 | Adamson et al. |
| 5,618,356 | A | 4/1997 | Adamson et al. |
| 5,620,536 | A | 4/1997 | Dahlback |
| 5,681,404 | A | 10/1997 | Adamson et al. |
| 5,699,396 | A | 12/1997 | Taylor |
| 5,835,550 | A | 11/1998 | Van Swam et al. |
| 5,876,524 | A | 3/1999 | Andersson |
| 6,125,161 | A | 9/2000 | Isobe et al. |
| 6,243,433 | B1 | 6/2001 | Adamson et al. |
| 6,690,759 | B1 | 2/2004 | Nanikawa et al. |
| 6,902,634 | B2 | 6/2005 | Jeong et al. |
| 2002/0136347 | A1 | 9/2002 | Jeong et al. |

FOREIGN PATENT DOCUMENTS

| | | |
|---|---|---|
| EP | 1 308 966 | 6/2009 |
| JP | 58-022364 | 2/1983 |
| JP | 06-317687 | 11/1994 |
| JP | 6-317687 | 11/1994 |
| JP | 8-262168 | 10/1996 |
| JP | 08-262168 | 10/1996 |
| JP | 09-145873 | 6/1997 |
| JP | 9257988 | 10/1997 |
| JP | 9272959 | 10/1997 |
| JP | 10-260280 | 9/1998 |
| JP | 3172731 | 3/2001 |
| JP | 2003-149365 | 5/2003 |
| WO | 00/37214 | 6/2000 |

OTHER PUBLICATIONS

Japanese Office Action dated Jun. 21, 2011 issued in corresponding Japanese Application No. 2005-257436 and English translation thereof.

Japanese Notice of Allowance dated Nov. 28, 2012 issued in corresponding Japanese Application No. 2005-257436 and English translation thereof.

ZIRCONIUM ALLOY FUEL CLADDING FOR OPERATION IN AGGRESSIVE WATER CHEMISTRY

BACKGROUND OF THE INVENTION

1. Field of the Invention

The present invention relates to zirconium alloys, particularly, to zirconium alloys for use in fuel cladding and structural applications within nuclear reactor vessels, and, more particularly, to zirconium alloys having improved corrosion resistance in aggressive water chemistry environments during the operation of boiling water reactors (BWR) and may have some utility in pressurized water reactors (PWR).

2. Background Art

Nuclear reactors are used in electric power generation, research and propulsion. A reactor pressure vessel contains the reactor coolant, i.e., water, which removes heat from the nuclear core. Piping circuits are used to carry the heated water or steam from the pressure vessel to the steam generators or turbines and to return or supply circulated water or feedwater to the pressure vessel. Typical operating pressures and temperatures for the reactor pressure vessels can be about 7 MPa and 288° C. for BWRs and about 15 MPa and 320° C. for PWRs. The materials used in these respective environments must, in turn, be formulated and/or manufactured to withstand various loading, environmental (high-temperature water, oxidizing species, radicals, etc.) and radiation conditions to which they will be subjected during extended operation of the reactor.

BWR and PWR typically include nuclear fuel sealed in cladding comprising one or more layers of metal or metal alloys to isolate the nuclear fuel from the moderator/coolant system, i.e., water in PWRs and steam and/or water in BWRs. The cladding typically includes at least one layer of a zirconium-based alloy including one or more alloying element and include layers of both a zirconium alloy and unalloyed zirconium. Cladding may also utilize a composite system having an inner lining of sponge zirconium or dilute zirconium alloy containing minor amounts, less than about 0.5 wt % of iron or other elements, as alloying metals. Typically, the cladding will be configured as a tube in which pellets of the nuclear fuel are stacked to fill substantially the entire length of the cladding tube. The tubes will then be arranged in bundles, with a plurality of bundles being arranged to define the reactor core.

Under normal operating conditions, zirconium-based alloys are useful as a nuclear fuel cladding material due to their relatively low neutron absorption cross sections and, at temperatures below about 398° C., their strength, ductility, stability, and lack of reactivity in the presence of demineralized water or steam. "Zircaloys" are a widely used family of commercially-available, corrosion-resistant, zirconium-based alloy cladding materials that include 97-99% by weight zirconium, with the balance being a mixture of tin, iron, chromium, nickel and oxygen. Two particular alloy compositions, specifically Zircaloy-2 and Zircaloy-4, are widely used for manufacturing cladding although Zircaloy-2 is the more commonly utilized composition for BWR applications.

In addition to zirconium, Zircaloy-2 includes about 1.2-1.7 wt % Sn; 0.07-0.20 wt % Fe; 0.05-0.15 wt % Cr, and 0.03-0.08 wt % Ni. Zircaloy-4, on the other hand, although including similar quantities of the other alloying elements present in Zircaloy-2, is substantially free of nickel and has an Fe concentration of about 0.18-0.24 wt %.

The presence of these alloying elements, which are relatively insoluble in zirconium under normal conditions, will generally result in the formation of Second Phase Particle (SPP) "precipitates" in an α-phase zirconium matrix. Under equilibrium conditions, the alloy matrix will be a single phase with the alloying elements present at concentrations at or near their respective solubility limits. The formation of precipitates results from the presence of alloying elements in concentrations above their solubility limits. For example, the precipitates most commonly found in Zircaloys may be generally represented by the chemical formulas $Zr(Fe,Cr)_2$ and $Zr_2(Fe,Ni)$.

Cladding corrosion occurs in both BWRs and PWRs with the corrosion typically occurring in nodular or uniform forms. Corrosion in nodular form is generally more prevalent in BWRs. Nodular corrosion is usually a porous near-stoichiometric zirconium oxide forming on the surface of the cladding. It can rapidly cover the entire surface of the Zircaloys in small, localized patches (referred to as "nodules" or "pustules") with thinner uniform corrosion in between. Uniform corrosion tends to be more prevalent in PWRs, and typically consists of a uniform layer of zirconium oxide forming on the surface of the cladding. The uniform layer typically contains a small excess of zirconium, appears as a black or gray film and exhibits semiconductive properties.

Normally the degree of uniform or nodular corrosion is acceptable and does not limit nuclear reactor operations. In some low frequency abnormal circumstances the degree of corrosion can become excessive and lead to through-wall cladding penetration and thus release highly radioactive species to the coolant and limit reactor operation.

Some corrosion failure mechanisms are now understood well enough to limit their occurrence. One such mechanism that occurs in BWRs is known as Crud Induced Localized Corrosion ("CILC"). The CILC mechanism involves a combination of cladding susceptible to nodular corrosion and a high concentration of copper in the coolant. The primary source of copper is from corrosion dissolution of brass materials used in steam condenser construction. Copper infiltrates the nodular oxide layer and creates a localized region that has low thermal conductivity thus leading to localized overheating and accelerated corrosion.

The problem of CILC has been addressed by controlling the coolant purity and minimizing cladding nodular corrosion. To control the coolant purity, steam condensers have been replaced with non-copper bearing materials, filtering systems optimized for copper removal are available, and monitoring for copper levels has been established. To minimize cladding nodular corrosion, processes that produce a fine SPP size (i.e., use of β or α+β heat treatments followed by low thermal input to prevent Ostwald ripening) have been implemented and preferable elemental compositions within the ASTM Zircaloy specification have been defined.

As will be appreciated, corrosion control and prevention is extremely important for the safe operation of nuclear reactors and corrosion-induced component failures have the potential for causing serious injury, reactor downtime and reduced efficiency. The physical, chemical and electrochemical interactions between the reactor components and the aqueous environment to which they are exposed during reactor operations are, understandably, significant factors for understanding and controlling corrosion. Accordingly, both the composition and surface conditioning of the reactor components and the composition and purity of the coolant water must be considered and an appropriate combination utilized to provide improved corrosion control.

Indeed, unacceptable levels of corrosion have been attributed to the presence of aggressive water chemistry conditions and its deleterious effect on fuel cladding materials. It is also believed that temporary excursions from the preferred reactor operating conditions can result in greatly accelerated corrosion rates. Thus, although the fuel cladding utilized in a reactor may have been processed in accord with the best practices recognized in the prior art for controlling corrosion, the use of such materials in aggressive water chemistry conditions and/or its exposure to periodic excursions may result in unacceptable corrosion rates, thereby increasing the risk of corrosion failures and the maintenance cost. The prior art knowledge includes alloy compositions within the ASTM specification for Zircaloy-2 as well as other Zr-based alloys such as that described in U.S. Pat. No. 4,664,727, a late stage solution heat treatment as outlined by U.S. Pat. Nos. 4,450,016, 4,576,654, and 5,437,747, restricted thermal input subsequent to the solution heat treatment as outlined by Japanese Patent Publications No. 3172731/2001. Despite the knowledge and development efforts represented by these prior art references, corrosion and the risk of corrosion failures is a continuing problem in the nuclear industry that past experience, design specifications and controls have not been able to eliminate completely. Further improvements toward preventing or suppressing corrosion remain necessary to achieve the goal of 100% fuel reliability desired for improved nuclear reactor operation and reduced maintenance costs, particularly in reactor systems that are, or may be, exposed to aggressive water chemistry conditions, whether the result of intentional addition of water conditioning packages, local conditions and/or episodic excursions from the desired water chemistry. As a result, there remains a need for improved cladding materials that can increase the operating margin of a reactor system by providing improved resistance to aggressive water chemistry environments.

Unfortunately, the particular chemistry and/or the particular condition that produce an aggressive water condition within the reactor water environment is often not well characterized, particularly in the event of excursions from standard operating conditions, such that variations in Zircaloy corrosion performance can occur between BWRs that operate with similar nominal reactor water chemistry. Transient aggressive environments, where one or more chemical species, known or unknown, are inadvertently introduced to the reactor coolant over a short period of time are, by their nature, difficult to detect and quantify. Robust cladding that can tolerate aggressive water chemistry environments without incurring unacceptable corrosion rates and increased risk of failure is highly desirable.

Impurities may be unintentionally introduced into the reactor water by various means such as spilling of cutting, cleaning, or hydraulic fluids, leaking of steam condenser tubes that carry impure secondary cooling water, incomplete cleaning following piping chemical decontamination operations, and/or compromised filtering equipment. Impurities from such sources may be in such low concentration that they go undetected and yet may still trigger accelerated cladding corrosion.

The corrosion kinetics of zirconium alloys typically exhibit two stages, for alloys such as the Zircaloys that contain SPPs of relatively insoluble transition metals such as Fe, Cr, Ni, V, etc. The initial corrosion typically comprises the diffusion-limited growth of a thin oxide film on the metal surfaces. Once this oxide film exceeds a thickness of about 2 μm, the film formation can begin to break down and may transition to an approximately linear growth phase with the multiple stages of diffusion-limited growth and breakdown occurring over extended exposure periods.

Previous approaches for controlling corrosion have included various modifications to the concentrations of alloying elements (particularly iron and nickel) in Zircaloy alloys to reduce the severity of nodular corrosion by increasing the availability of aliovalent ions that, in turn, improves the uniformity of the oxide.

The SPPs play an important role in the corrosion behavior of the alloy(s) in which they are formed with the precipitate composition, average precipitate size and the precipitate distribution (i.e., the interparticle spacing) affecting, perhaps significantly, the corrosion properties of the particular alloy. An approach commonly pursued in parallel with alloy chemistry control involves controlling the size and distribution of the SPPs, particularly within the surface regions of the reactor fuel assembly components. As a result of the difference in corrosion mechanisms acting in BWRs and PWRs, conventional Zircaloy cladding compositions are prepared differently with those intended for use in PWR applications being subjected to higher temperature anneals and slow quenches (less than 5° C./second) to produce relatively larger precipitate sizing. Conversely, cladding compositions intended for use in BWR applications utilizing lower temperature anneals and with fast quenches (greater than 5° C./second and more typically greater than 20° C./second) to produce relatively smaller precipitate sizing.

To improve the intergranular and intragranular distribution of SPPs within Zr—Sn—Fe alloys of the present invention, the alloy may be heated into the β-phase temperature range, e.g., above about 1000° C., to form a solid solution that is substantially free of SPPs. The β-phase alloy can then be rapidly quenched to produce a substantially diffusionless martensitic transformation, particularly in the surface regions exposed to the quenching composition. By cooling the alloy rapidly, i.e., a rate greater than about 500° C./second, through the α+β-phase temperature range, approximately 825-965° C., and into the α-phase range, typically below about 800° C., the alloying elements will tend to remain in a supersaturated metastable solution in the zirconium matrix. At slower cooling rates, however, the alloying elements will tend to nucleate and grow SPPs whose final size depends on the cooling rate, with slower quench rates resulting in relatively larger SPPs. Subsequent heat treatments in the α-phase after the rapid quench will allow $Zr(Fe, Cr)_2$ and $Zr_2(Fe, Ni)$ SPPs to grow, or to nucleate and grow from the metastable solid solution. Although the size and distribution of SPPs can be controlled to some extent by thermal-mechanical processing, in order to prevent excessive growth of the SPPs it is necessary to limit the subsequent thermal exposure of a Zircaloy component after an initial heat treatment to dissolve the SPPs.

Accordingly, zirconium alloys are now extensively used as fuel cladding materials and fuel assembly materials in BWRs, PWRs and other nuclear applications. As noted above, two of the most common zirconium alloys in use are Zircaloy-2 and Zircaloy-4. Additional details regarding the specific alloys corresponding to Zircaloy-2 and Zircaloy-4, are provided in U.S. Pat. Nos. 2,772,964 and 3,148,055, the disclosures of which are hereby incorporated by reference in their entirety.

In addition to the basic composition of the alloy, conventional techniques for reducing or preventing nodular corrosion include heat treatment methods in which an alloy is heated, for a short period of time, to a temperature at which the alloy exists in α+β or β phase, after which the alloy is rapidly quenched, to control the microstructure. Such a process is described in Japanese Patent Publications Nos. 45699/1986 and 58223/1988 and the application of such a method in connection with a particular alloy composition is detailed in Japanese Laid-Open Patent Publications Nos. 43450/1985 and 228442/1987. Similarly, another approach for providing improved nodular corrosion resistance involves applying a heat treatment to only the outer region of the cladding tube as detailed in U.S. Pat. No. 4,576,654.

In order to continue improving the cladding performance and reactor efficiency, there continues to be a need to develop zirconium alloys that have increased corrosion resistance in adverse water chemistry conditions and can be manufactured efficiently and economically.

SUMMARY OF THE INVENTION

In accordance with an exemplary process according to the present invention, a Zircaloy-2 alloy ingot having a composition selected from within the composition range provided for exemplary alloys according to the present invention is formed by melting zirconium and appropriate quantities of the alloying elements. The alloy ingot may utilize a multiple melt process for improving the compositional uniformity. The ingot may then be formed into a billet, preferably a hollow, generally cylindrical billet when fabricating cladding tubes, by hot forging, machining or a combination of processes. Preferred Zircaloy-2 compositions for use in the billet will include a Sn concentration of between about 1.30-1.60 wt %, a Cr concentration of about 0.06-0.15 wt %, a Fe concentration of about 0.16-0.20 wt %, and a Ni concentration of about 0.05-0.08 wt %, with the total content of the Fe, Cr and Ni being above about 0.31 wt %.

The billet will then be subjected to a β-quench process, followed by additional fabrication processes and heat treatments to form cladding tubes. Following the billet quench process, the billet will be extruded followed by multiple stages of cold reduction to reduce the extruded billet to near-final cladding wall thickness and diameter. Following each cold-reduction stage, an annealing treatment will be conducted. Exemplary embodiments of cladding tubes according to the present invention will include a late-stage solution treatment process (treatment in the beta phase field is preferred), whereby only the outer region of the tube is heat treated and the inner region of the tube is not heat treated by means of suitable cooling, such as flowing cold water. The late-stage solution-treated (beta is preferred) tubes may receive typically one to three additional cold-reduction and annealing cycles following the billet extrusion. When a preferred overall 3-stage cold-reduction schedule is used, the late-stage solution-treatment can be performed after the first, second, or third stage following the billet extrusion but preferably after the first stage.

Following the late-stage solution treatment, annealing treatments will be limited to less than about 625° C. and durations sufficient to induce stress relief or recrystallization, but short enough so as not to promote significant Ostwald ripening, thereby maintaining a distribution of very fine SPPs, e.g., having a mean diameter of less than about 40 nm, and, preferably, less than about 30 nm. As the mean diameter of the precipitates decreases, the relative surface area increases, thereby allowing them to dissolve more readily. It is preferred that the mean diameter of the precipitates be of sufficient size whereby the size and distribution of precipitates throughout the cladding or other component exhibit general uniformity in at least the surface regions. The mean diameter and distribution of precipitates within an alloy composition may be easily determined using transmission electron microscopy (TEM) techniques known to those of ordinary skill in the art.

Exemplary embodiments of cladding tubes according to the invention will also exhibit a very smooth surface, e.g., a surface roughness of less than about 0.5 μm Ra, preferably a surface roughness of less than about 0.25 μm Ra, more preferably a surface roughness of less than about 0.15 μm Ra, and most preferably a surface roughness of less than about 0.10 μm Ra. It is believed that the reduced surface roughness will render such cladding less likely to form scale deposits that can contain or trap impurities from the coolant that can harm the cladding and thus accelerate corrosion. Cladding tubes fabricated according to the exemplary embodiments of the invention may also include additional inner liner or barrier layers of zirconium or other zirconium alloy compositions. In particular zirconium alloys microalloyed with Fe at levels between about 0.085 and 0.2 wt % are useful as liner layers.

DETAILED DESCRIPTION OF EXEMPLARY EMBODIMENTS

Figure 1:
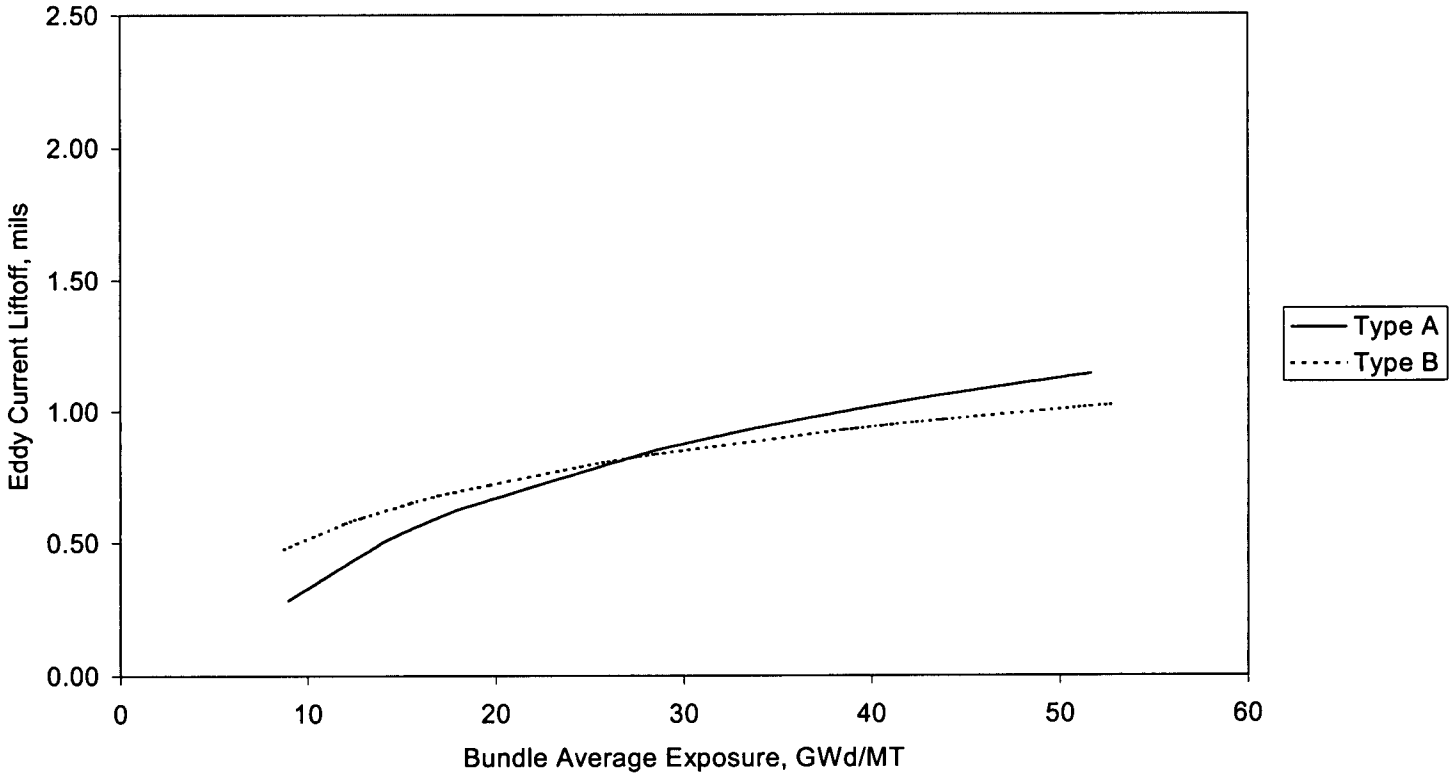
FIG. 1 illustrates the eddy current liftoff data for Type A and Type B Zircaloys as a function of bundle average exposure.

In accordance with an exemplary process according to the present invention, a Zircaloy-2 alloy ingot having a Sn concentration of within a range selected from 1.30-1.60 wt %. The other alloying elements will include a Cr concentration of about 0.06-0.15 wt %, a Fe concentration of about 0.16-0.24 wt % and a Ni concentration of about 0.05-0.08 wt %. The total content of the Fe, Cr and Ni alloying elements included in the alloy will be above about 0.31 wt %.

An ingot having an appropriate composition is then preferably formed into a hollow billet by hot forging, machining or a combination of processes. The billet is then subjected to a β-quench process in which the billet is heated to a temperature typically above about 965° C., but preferably between about 1000-1100° C., maintained at or near that temperature for a period of typically at least 2 minutes, and then rapidly quenched to a temperature well below the α+β-phase range, e.g., below about 500° C. and typically below about 250° C. Depending on the configuration and composition of the billet and the quenching medium, quench rates as high as 500° C./second may be obtained. The use of a hollow billet, with its reduced cross-sectional area, allows quenching from both inner and outer surfaces and produces a more uniform alloy/precipitate composition and therefore a finer mean SPP size.

The β-quenched billet may then be subjected to additional fabrication processing such as hot working, cold working and machining with intermediate heat treatments to restore the ductility that was decreased by the fabrication processes. When fabricating fuel rod cladding, for example, the β-quenched billet may be machined and prepared for extrusion to produce a single-walled cladding tube or for co-extrusion with other materials to form multiple-walled, lined, or composite cladding tubes.

In the production of a single-walled cladding tube, the β-quenched billet may be heated to about 680° C. and extruded to form a tubeshell having an outside diameter ranging from approximately 40 to 100 mm. In the production of a multiple-walled cladding tube, a composite cladding tube or a lined cladding tube, a hollow billet of the material intended for the inner wall(s) or lining is inserted into a β-quenched hollow billet of the alloy composition intended for the outer wall. Although the exemplary alloy compositions are preferred for use as the outer wall, one or more of the hollow billets used to form multiple-walled cladding tubes may be similar β-quenched billets. The assembled billets may be welded together and then co-extruded to form a hollow tubeshell. The extruded tubeshell may also be subjected to additional pilgering and/or heat treatments, at temperatures preferably below about 625° C., to complete the fabrication process and obtain a cladding tube having a diameter on the order of 10 mm and a wall thickness on the order of 0.75 mm.

The heat treatment and/or annealing of zirconium alloys may be generally grouped by the temperature of post-cold reduction heat treatment as follows: a) temperatures above 480° C. provide stress relief, typically after an area reduction of about 70%; b) temperatures above about 576° C. provide both stress relief and induce recrystallization of the alloy, improving ductility, and some precipitate growth; and c) temperatures substantially above 576° C. result in recrystallization and significant precipitate growth.

As used herein, "a crystalline structure" or "α-phase" refers to the stable close-packed hexagonal crystal lattice structure of zirconium and zirconium-containing alloys present at lower temperatures. The temperature range in which the α-phase is stable is, correspondingly, referred to as the α-range. For Zircaloy-2, for example, the pure α-phase (in which SPPs may also be distributed) exists at temperatures below about 825° C. Further, as used herein, "β crystalline structure" or "β phase" refers to the generally body-centered cubic crystal lattice structure of zirconium and zirconium-containing alloys stable at higher temperatures. The temperature range in which the β-phase is stable is referred to as the β-range. For Zircaloy-2, the pure β-phase exists at temperatures above about 965° C.

Similarly, the term "α+β crystalline structures" or "α+β-phase" refers to a mixture of the α and β phases that exists in some zirconium alloys at intermediate temperatures. For pure zirconium, the α crystalline structure is stable up to about 860° C. while at higher temperatures a phase change occurs to form a β crystalline structure which is stable at temperatures above about 860° C. Zirconium alloys, in contrast, have a range of temperatures over which this a phase to β phase change occurs and within which a mixture of both α and β crystalline structures are stable. The specific temperature range in which such a mixture is stable is a function of the specific alloy composition. Zircaloy-2, for example, tends to exhibit a stable mixture of α and β crystalline structures from about 825° C. to about 965° C. with intermetallic precipitates tending to form at temperatures below about 825° C.

As noted above, the anneal temperatures utilized after cold working will affect the grain structure as well as the precipitate structure. Depending on the amount of cold work imposed, subsequent heat treatments can result in either stress relief or recrystallization. For a given level of cold work, a lower heat treat temperature results in stress relief, while a higher heat treat temperature promotes recrystallization.

According to the exemplary embodiments of the present invention, a hollow billet having an appropriate Zircaloy-2 composition will be subjected to a β-quench process followed by multiple reduction and annealing sequences. As a part of the fabrication processes and heat treatment sequence, the tubes will be subjected to a late stage β-treatment to produce fine SPPs in the outer region of the tube, followed by additional fabrication processes and heat treatments to form cladding tubes. The late-stage β-treatment is a process in which only the outer portion of the tube is subjected to heat treatment to a temperature in the β-range, e.g., above about 965° C. but preferably between about 1000 and 1100° C., while the inner part of the tube is cooled by suitable means, e.g., cold water. Although an outer surface quench is preferred, depending on the configuration of the tube and the cooling means utilized, a throughwall quench during which substantially the full thickness of the tube wall is treated may be possible. The heat treatments following the late stage β-treatment will be limited to temperatures of less than about 625° C. and will have sufficiently limited duration just sufficient to cause full recrystallization at each stage, thereby generally maintaining the distribution of very fine SPPs having a mean diameter of less than about 40 nm, and preferably, less than about 30 nm.

Exemplary embodiments of cladding tubes according to the invention will also be processed to obtain a very smooth exterior surface, e.g., a surface roughness of less than about 0.5 μm Ra, preferably a surface roughness of less than about 0.25 μm Ra, more preferably a surface roughness of less than about 0.15 μm Ra, and most preferably a surface roughness of less than about 0.10 μm Ra. Cladding tubes fabricated according to the exemplary embodiments of the invention may also include additional inner liner or barrier layers of zirconium or other zirconium alloy compositions. In particular zirconium alloys microalloyed with Fe at levels between about 0.085 and 0.200 wt % are usefuil as liner layers.

The Applicants' development work with Zircaloy-2 cladding tubes has led the Applicants to a more complete understanding of the factors leading to improved corrosion resistance in aggressive water chemistry environments within BWRs. In particular, the role of SPP size in the corrosion process for Zircaloy compositions was evaluated with cladding samples, designated as Type A, incorporating SPPs having a mean diameter of less than about 40 nm and fabricated with a hollow billet beta quench and late stage β treatment, and cladding samples, designated as Type B, incorporating SPPs having a mean diameter of between about 40 nm and 70 nm and fabricated with a solid billet beta quench and late stage α+β treatment. In particular, fuel cladding eddy current lift-off measurements (which are useful to estimate the amount of corrosion) of the Type A and Type B samples suggest that they exhibit generally similar corrosion performance under normal reactor operating conditions. FIG. 1. However, as reflected below in TABLE 1, when the Type A and Type B cladding samples are exposed to a water chemistry believed to be unusually aggressive, the Type A cladding exhibits superior corrosion resistance, a result generally contrary to the teachings of the prior art.

TABLE 1

COMPARISON OF TYPE A AND TYPE B CLADDINGS IN BWR CORROSION PERFORMANCE

| Cladding Type | Nominal mean SPP diameter | Maximum Eddy Current Liftoff |
|---|---|---|
| Zircaloy-2/Type A | 20–40 nm | 13.4 μm |
| Zircaloy-2/Type B | 40–70 nm | 25.8 μm |

Indeed, data collected and widely disseminated by F. Garzarolli and others of particular influence in the field have consistently taught those practicing in the art that Zircaloy compositions with SPP particles having a mean size of less than about 40 nm will experience equal or greater corrosion than Zircaloy compositions with SPP particles having a mean size between about 40-70 nm. The Applicants' experience with small-particle fuel cladding corrosion in a BWR, however, has been contrary to this conventional understanding promoted by F. Garzarolli and others as reflected in, for example, Garzarolli, F. Schumann, R., and Steinberg, E., "Corrosion Optimized Zircaloy for Boiling Water Reactor (BWR) Fuel Elements," Zirconium in the Nuclear Industry: Tenth International Symposium, ASTM STP 1245, A. M. Garde and E. R. Bradley, Eds., American Society for Testing and Materials, Philadelphia, 1994, pp. 709-23, the contents of which are hereby incorporated by reference in their entirety.

Surprisingly, the performance advantages of the exemplary SPP size in aggressive aqueous environments summarized above in TABLE 1 is opposite that which would be expected or anticipated by those of ordinary skill in the art and thus encompasses alloy compositions and microstructure that those guided by the conventional understanding of the Zircaloy-2 corrosion process would endeavor to avoid incorporating in a reactor component.

Inspired by the discovery of the unexpected superiority of Type A cladding, cladding compositions and fabrication methods were modified further in an effort to produce a cladding material that exhibited improved resistance to atypical or episodic aggressive environmental conditions that may be expected to occur during the operating life of the reactor component. Although exemplary alloys according to this invention may be used in all conventional BWR environments, the greatest benefit lies in their improved resistance to corrosion during non-standard operating conditions, whether localized or general, that create, at least temporarily, an aggressive aqueous environment under which conventional Zircaloy alloys would tend to exhibit unacceptable corrosion rates. Thus, although a variety of Zircaloy compositions have been previously utilized in the fabrication of reactor components and solution heat treated to produce cladding materials having improved nodular corrosion resistance, the prior art did not fully recognize the advantages provided by alloys according to the present invention.

A first exemplary cladding composition, Type C, is similar to Type A cladding in that both were fabricated using a hollow billet beta quench, a three step reduction process, and β solution treatment after the first reduction stage, to produce a mean SPP size of less than about 40 nm. However, Type C cladding has narrower allowable ranges for extrusion and intermediate annealing temperatures, a smoother surface finish and a tighter alloy composition range. A second exemplary cladding composition, Type D, has a composition substantially identical to that of the Type C cladding, but utilizes an α+β solution treatment and exhibits a corresponding increase in mean SPP size of between about 40 and 70 nm.

Figure 2:
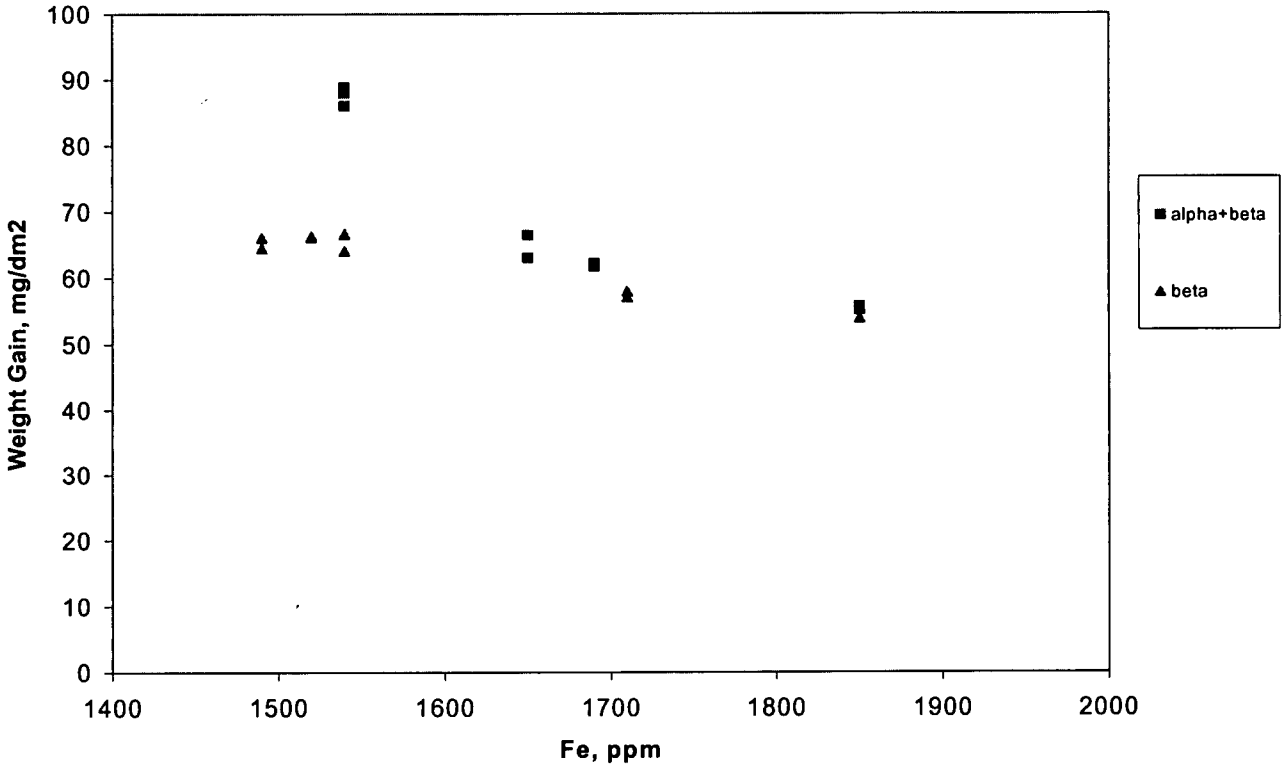
FIG. 2 illustrates the coupon weight gain as a function of iron (Fe) concentration and the method of heat treatment applied to the composition for Type C and Type D Zircaloys.
Figure 3:
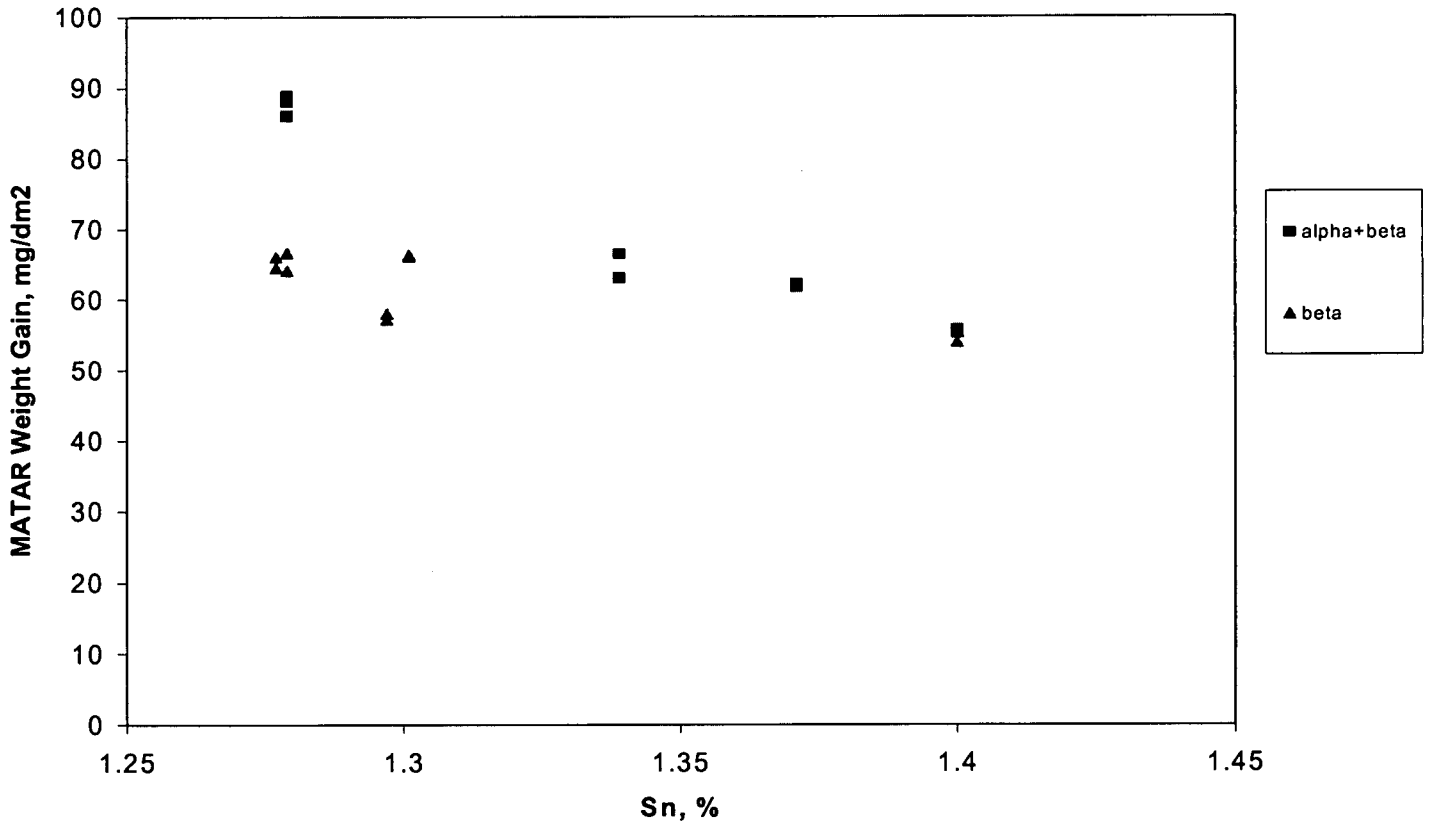
FIG. 3 illustrates the coupon weight gain as a function of tin (Sn) concentration and the method of heat treatment applied to the composition for Type C and Type D Zircaloys.

Development of Type C and Type D cladding materials led to the discovery of specific concentration ranges, in particular the lower limits, of iron and tin that provide improved nodular corrosion resistance relative to the conventional Zircaloy compositions. As shown in FIGS. 2 and 3, which illustrate corrosion weight gain in a two-step steam test as disclosed in U.S. Pat. No. 4,440,862, there is reduced weight gain for both Type C and D cladding when the iron content and tin content are increased within the ASTM composition range for Zircaloy-2, however the benefit is most pronounced for Type D cladding. With a desired weight gain in the two-step steam test of less than 80 mg/dm$^2$, the results in FIGS. 2 and 3 illustrate the benefit of restricting the alloying composition range to above 0.16% Fe, shown at about 0.17 and above wt % iron by beta results at approximately 1700 ppm and up in FIG. 2, and 1.30% Sn.

Although this invention has been described with reference to exemplary embodiments, it should be understood that the present invention is not so limited and that those of ordinary skill in the art will recognize that various modifications, particularly with respect to the composition and relative thickness of the various layers may be made without departing from the spirit and the scope of the invention as defined by the following claims.

We claim:

1. A method for manufacturing a nuclear reactor component comprising:

preparing a zirconium-base alloy including a tin content of between about 1.30 and 1.60 wt %;

a chromium content of between about 0.06 and 0.15 wt %;

an iron content of between about 0.17 and 0.24 wt %; and a nickel content of between about 0.05 and 0.08 wt %;

wherein a total content of the iron, chromium and nickel included in the zirconium-base alloy is no less than about 0.31 wt %; a balance being zirconium and unavoidable impurities;

forming a hollow billet from the zirconium-base alloy, the hollow billet having an outer diameter ranging from 40 to 100 mm;

performing a rapid β-quench on the hollow billet with a quench rate on an outer surface of at least 50° C./second to a temperature below 300° C. to form a quenched billet;

forming the nuclear reactor component from the quenched billet;

performing a post-extrusion late-stage beta quench on the component with a quench rate on the outer surface of at least 100° C./second to a temperature below 300° C.; and completing formation of the nuclear reactor component;

wherein formation of the nuclear reactor component is limited to an extrusion temperature of less than about 680° C. and a temperature less than about 625° C. at all stages after extrusion, exclusive of the post-extrusion late-stage solution treatment;

wherein the nuclear reactor component includes a surface region including secondary phase precipitates, the secondary phase precipitates having a mean diameter no greater than about 40 nm; and further wherein a wetted surface of the nuclear reactor component has a surface roughness no greater than about 0.50 μm Ra.

2. The method for manufacturing a nuclear reactor component according to claim 1, wherein:

the zirconium-base alloy is Zircaloy-2 and the iron content is between about 0.17 and 0.20 wt %.

3. The method for manufacturing a nuclear reactor component according to claim 1, wherein:

the zirconium-base alloy is Zircaloy-2 and the iron content is between about 0.18 and 0.22 wt %.

4. The method for manufacturing a nuclear reactor component according to claim 1, wherein:

the iron content is between about 0.20 and 0.24 wt %.

5. The method for manufacturing a nuclear reactor component according to claim 1, wherein:

the surface roughness is no more than about 0.25 μm Ra.

6. The method for manufacturing a nuclear reactor component according to claim 1, wherein:

the surface roughness is no more than about 0.10 μm Ra.

7. The method for manufacturing a nuclear reactor component according to claim 1, wherein:

forming the nuclear reactor component from the quenched billet includes one or more operations selected from the group consisting of extrusion, coextrusion, hot rolling, cold rolling, milling, polishing, pilgering, stress relief or recrystallization anneals, and heat treating.

8. The method for manufacturing a nuclear reactor component according to claim 7, wherein:

any stress relief or recrystallization anneal conducted when forming the nuclear reactor component is conducted at a temperature of less than about 625° C.

9. The method for manufacturing a nuclear reactor component according to claim 1, wherein:

the zirconium-base alloy is Zircaloy-2 and the secondary phase precipitates have a mean size between about 20 nm and about 40 nm.

10. The method for manufacturing a nuclear reactor component according to claim 1, wherein:

the zirconium-base alloy is Zircaloy-2 and the secondary phase precipitates have a mean size no greater than about 30 nm.

11. The method for manufacturing a nuclear reactor component according to claim 1, further comprising:

forming a smooth surface on a major portion of an exterior surface of the nuclear reactor component, the smooth surface having an average surface roughness no greater than about 0.25 μm Ra.

12. The method for manufacturing a nuclear reactor component according to claim 1, further comprising:

forming a smooth surface on a major portion of an exterior surface of the nuclear reactor component, the smooth surface having an average surface roughness no greater than about 0.15 μm Ra.

13. The method for manufacturing a nuclear reactor component according to claim 1, further comprising:

forming a smooth surface on a major portion of an exterior surface of the nuclear reactor component, the smooth surface having an average surface roughness no greater than about 0.10 μm Ra.

14. The method for manufacturing a nuclear reactor component according to claim 1, further comprising:

forming a second hollow billet, the second hollow billet including zirconium;

combining the quenched hollow billet and the second hollow billet to form a composite hollow billet, whereby an interior surface of the second hollow billet forms an interior surface of the composite hollow billet; and forming the nuclear reactor component from the composite hollow billet.

15. The method for manufacturing a nuclear reactor component according to claim 14, wherein:

the second hollow billet consists essentially of zirconium.

16. The method for manufacturing a nuclear reactor component according to claim 14, wherein:

the second hollow billet includes zirconium microalloyed with between about 0.085 and about 0.20 wt % iron.

17. The method for manufacturing a nuclear reactor component according to claim 1, wherein the post-extrusion late-stage beta quench has a quench rate on the outer surface of 500° C./second.

18. The method for manufacturing a nuclear reactor component according to claim 1, wherein at least one of the rapid β-quench and the post-extrusion late-stage beta quench is performed to a temperature below 250° C.

19. The method for manufacturing a nuclear reactor component according to claim 1, wherein the component has a wall thickness of 0.75 mm.

* * * * *